US006592347B2

(12) United States Patent
Matsumoto et al.

(10) Patent No.: US 6,592,347 B2
(45) Date of Patent: Jul. 15, 2003

(54) ROTARY COMPRESSOR

(75) Inventors: Kenzo Matsumoto, Ora-gun (JP); Takashi Sunaga, Ora-gun (JP); Dai Matsuura, Ota (JP); Yasuki Takahashi, Sawa-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/043,269

(22) Filed: Jan. 14, 2002

(65) Prior Publication Data

US 2002/0150493 A1 Oct. 17, 2002

(30) Foreign Application Priority Data

Feb. 14, 2001 (JP) ..... 2001-37122

(51) Int. Cl.[7] ..... F04C 18/00
(52) U.S. Cl. ..... 418/63; 418/178; 418/179
(58) Field of Search ..... 418/63, 178, 179

(56) References Cited

U.S. PATENT DOCUMENTS 5,090,882 A * 2/1992 Serizawa et al. ..... 418/63
5,273,410 A * 12/1993 Kitaichi et al. ..... 418/179
5,518,381 A * 5/1996 Matsunaga et al. ..... 418/100
5,685,703 A * 11/1997 Fukuoka et al. ..... 418/63
5,951,273 A * 9/1999 Matsunaga et al. ..... 418/63
6,132,195 A * 10/2000 Ikoma et al. ..... 418/63
6,139,296 A * 10/2000 Okajima et al. ..... 418/63
6,435,850 B2 * 8/2002 Sunaga et al. ..... 418/63

FOREIGN PATENT DOCUMENTS

JP 08-042473 * 2/1996 ..... 418/63

* cited by examiner

*Primary Examiner*—Thomas Denion
*Assistant Examiner*—Theresa Trieu
(74) *Attorney, Agent, or Firm*—Armstrong, Westerman & Hattori, LLP

(57) ABSTRACT

There is provided a highly reliable rotary compressor which uses polyalkylene glycol as a lubricant or polyalfa olefin as base oil in a compressor utilizing as a refrigerant carbon dioxide which is a natural refrigerant, and prevents abnormal abrasion of a roller and a vane.

In a rotary compressor which uses carbonic acid gas as a refrigerant, polyalkylene glycol (determined as a formal nomenclature) as a lubricant, or polyalfa olefin or mineral oil as base oil, there is used a vane whose radius of curvature (Rv) (cm) at a sliding contact portion with respect to said roller can be represented by the following expression (1):

$$T<Rv<Rr \qquad \text{Expression (1)}$$

[where T is a thickness (cm) of the vane, Rr is a radius of curvature (cm) of an outer periphery of the roller which slidingly comes into contact with the vane]

11 Claims, 5 Drawing Sheets

ROTARY COMPRESSOR

BACKGROUND OF THE INVENTION (i) Field of the Invention

The present invention relates to a rotary compressor which uses carbonic acid gas as a refrigerant and uses polyalkylene glycol or polyalfa olefin as a lubricant or mineral oil as base oil, and more particularly to a structure of a roller and a vane which prevents abnormal abrasion of the roller and vane and is suitable for providing a reliable rotary compressor.

(ii) Description of the Related Art

A compressor used in a refrigerator, an automatic vending machine, a compressor for a showcase or an air conditioner for home/business use has been conventionally utilizing a large amount of dichlorodifluoromethane (R12) or monochlorodifluoromethane (R22) as a refrigerant. Such R12 or R22 is a target of control of CFC's because it has a problem that it destroys an ozone layer due to ozone crack potential when it is discharged into air and reaches the ozone layer in the upper air above the earth. The destruction of the ozone layer is provoked by a chloric group (C1) in the refrigerant. Thus, a refrigerant containing no chloric group, for example, an HFC-based refrigerant such as R32, R125 or R134a, a hydrocarbon group refrigerant such as propane or butane, or a natural refrigerant such as carbonic acid gas or ammonia is considered as an alternative refrigerant.

FIG. 1 is a view showing a cross-sectional structure of a two-cylinder type rotary compressor to which the present invention is applied. FIG. 2 is a cross-sectional explanatory view showing the relationship between a cylinder, a roller, a vane and others. FIG. 3 is an explanatory view of the vane. The rotary compressor denoted by reference numeral 1 as a whole includes a cylindrical closed container 10, an electric motor 20 and a compressor 30 accommodated in the closed container 10. The electric motor 20 has a stator 22 and a rotor 24 fixed on the inner wall portion of the closed container 10, and a rotary shaft 25 attached at the center of the rotor 24 is rotatably supported by two plates 33 and 34 which close opening portions of cylinders 31 and 32. A crank portion 26 which is eccentrically provided is formed at a part of the rotary shaft 25. The cylinders 31 and 32 are provided between the two plates 33 and 34. The cylinders 31 and 32 (description will be mainly given as to the cylinder 32 hereinafter) have an axis line which is the same as that of a rotary shaft 25. An inlet 23 and an outlet 35 for the refrigerant are provided to the circumferential wall portion of the cylinder 32.

A ring-like roller 38 is provided in the cylinder 32, and the inner peripheral surface 38 B of the roller 38 comes into contact with the outer peripheral surface 26A of the crank portion 26. The outer peripheral surface 38A of the roller 38 comes into contact with the inner peripheral surface 32B of the cylinder 32. A vane 40 is provided to the cylinder 32 so as to be capable of sliding, and an end of the vane 40 comes into contact with the outer peripheral surface 38A of the roller 38. When impetus is given to the vane 40 toward the roller 38 and the compressed refrigerant is led to the back surface of the vane 40, sealing between the end of the vane and the roller 38 is secured. A compression chamber 50 is formed by being surrounded by the vane 40, the roller 38, the cylinder 32 and the plate 34 which closes the cylinder 32 and others. In the rotary compressor 1, for example, polyol ester as a lubricant or polyvinyl ether or the like as base oil is used.

Thus, when the rotary shaft 25 rotates in the counter-clockwise direction in FIG. 2, the roller 38 also eccentrically rotates in the cylinder 32, and the coolant gas sucked from the inlet 23 is compressed and discharged from the outlet 35. In the suction-compression-discharge stroke, pressing force Fv is generated at a contact portion between the roller 38 and the vane 40.

Conventionally, a contact surface 40A at the end of the vane 40 with respect to the outer peripheral surface 38A of the roller 38 is formed into a circular shape having a radius of curvature Rv. This radius of curvature Rv has a value which is substantially equal to a width dimension T of the vane 40 and is approximately 1/10 to 1/3 with respect to a radius dimension of the roller 38. Further, as a material of the roller 38, one obtained by hardening cast iron or alloy cast iron is mainly used. Also, as a material of the vane 40, stainless steel, tool steel or one obtained by applying surface finishing such as nitriding treatment to such a material is mainly used. In particular, it is general to give the high hardness and toughness to the vane material.

As shown in FIG. 4, the contact state between the roller 38 and the vane 40 can be substituted by a problem of contact between the cylinders having different curvatures. In such a state, when the two elastic substances of the roller 38 and the vane 40 are pressed against each other by the pressing force Fv of the vane 40, they generally have the surface contact instead of the point or line contact. A length of the elastic contact surface d at that moment can be calculated by the expression (7), and the Hertz stress Pmax ($kgf/cm^2$) represented by the following expression (9) is generated at the contact portion (Hertz theory of elastic contact).

$$P\max=4/\pi\cdot Fv/L/d \qquad \text{Expression (9)}$$

(Fv, L and d in the expression (9) are equal to those in the expression (7))

When the surface contact is provided and the Hertz stress is increased in this manner, nitriding treatment for improving the abrasion resistance or surface treatment such as ion coating of CrN is performed to the vane of the rotary compressor which uses the refrigerant including no chlorine in its molecules and employs polyol ether as a lubricant or polyvinyl ether as base oil. However, there are problems that nitriding treatment does not provide the sufficient proof strength, ion coating of CrN may lead to exfoliation of a coating layer and the production cost is increased.

SUMMARY OF THE INVENTION

In order to solve the above-described problems in the prior art, it is an object of the present, invention to provide a highly reliable rotary compressor which uses polyalkylene glycol as a lubricant or polyalfa olefin as base oil in a compressor utilizing carbon dioxide which is a natural refrigerant as a refrigerant, and which prevents abnormal abrasion of a roller and a vane.

As a result of attentive study in order to solve the problems, the radius of curvature of the contact surface at the end of the vane which comes into contact with the outer peripheral surface of the roller is changed, although it has a value substantially equal to the width dimension of the vane. In particular, in the rotary compressor using carbon dioxide which is a natural refrigerant as an alternative refrigerant, the radius of curvature is set larger than the width dimension of the vane in a range for assuring the sliding contact surface at a sliding contact portion of the vane and the roller, and polyalkylene glycol as a lubricant or polyalfa olefin or mineral oil as a lubricant is used. Consequently, the Hertz stress can be reduced, and the sliding distance is increased. Furthermore, the stress is dispersed, and a temperature at the sliding contact portion of the vane and the roller can be lowered. Therefore, the present inventor has found that it is possible to provide the highly reliable rotary compressor which has an advantage of sufficiently reducing abrasion of the outer peripheral surface of the roller or the vane by the inexpensive nitriding processing (NV nitriding, sulphonitriding, radial nitriding) without applying the expensive coating treatment to the vane and prevents abnormal abrasion of the roller and the vane, and has attained the present invention.

To achieve this aim, according to the present invention, there is provided a rotary compressor defined in claim 1 including a refrigerating circuit constituted by sequentially connecting a compressor, a condenser, an expander, an evaporator and others by pipes, and using carbonic acid gas as a refrigerant, polyalkylene glycol as a lubricant or polyalfa olefin or mineral oil as a lubricant, the rotary compressor comprising: a cylinder having an inlet and an outlet; a rotary shaft having a crank portion provided on an axial line of the cylinder; a roller which is provided between the crank portion and the cylinder and eccentrically rotates; and a vane which reciprocates in a groove provided to the cylinder and slidingly comes into contact with an outer peripheral surface of the roller, wherein a radius of curvature of the vane at a sliding contact portion with respect to the roller (Rv) (cm) can be represented by the following expression (1).

$$T<Rv<Rr \qquad \text{Expression (1)}$$

[where T is a thickness (cm) of the vane and Rr is a radius of curvature at the outer periphery of the roller which slides with respect to the vane]

Further, according to the present invention, there is provided a rotary compressor defined in claim 2, wherein, in order to assure a sliding contact surface at a sliding portion of a vane and a roller, T, RV, Rr, E, α, ev have the relationship which can be represented by the following expressions (2) to (4):

$$T>2\cdot Rv\cdot E/(Rv+Rr) \qquad \text{Expression (2)}$$

$$\sin\alpha=E/(Rv+Rr) \qquad \text{Expression (3)}$$

$$ev=Rv\cdot E/(Rv+Rr) \qquad \text{Expression (4)}$$

where E is eccentricity (cm) of a rotation center (O1) of a rotary shaft and a center of the roller (O2), α is an angle formed by a linear line (L1) connecting a center (O3) of a radius of curvature (Rv) of the vane and a roller center (O2) and a linear line (L2) connecting the center (O3) and the rotation center (O1), and ev is a sliding distance between a point at which the linear line (L1) intersects an outer peripheral surface of the roller and a point at which the linear line (L2) intersects with the outer peripheral surface of the roller.

Furthermore, according to the present invention, in addition to claim 1, there is provided a rotary compressor defined in claim 3, wherein, in order to assure a sliding contact surface at a sliding portion of a vane and a roller in consideration of elastic contact during high-load operation, T, Rv, Rr, E and d have the relationship which can be represented by the following expression (8):

$$T>[2\cdot Rv\cdot E/(Rv+Rr)]+d \qquad \text{Expression (8)}$$

[where T, Rv, Rr and E denote the same terms as those in the expressions (1) and (2)]

where L (cm) is a height of the vane is, E1 and E2 (kgf/cm$^2$) are modulus of longitudinal elasticity of the vane and that of the roller, respectively, ν1 and ν2 are a Poisson's ratio of the vane and that of the roller, respectively, ΔP (kgf/cm$^2$) is a design pressure, ρ is an equivalent-radius (cm) calculated by the expression (5) , Fv(kgf) is pressing force of the vane calculated by the expression (6), and d(cm) is a length of an elastic contact surface calculated by the expression (7) using these terms.

$$\frac{1}{\rho}=\frac{1}{Rv}+\frac{1}{Rr} \qquad \text{Expression (5)}$$

[where ρ is an equivalent-radius (cm), Rv is a radius of curvature of the vane (cm), and Rr is a radius of curvature of the outer periphery of the roller which slidingly comes into contact with the vane.]

$$Fv=T\cdot L\cdot\Delta P \qquad \text{Expression (6)}$$

[where Fv is pressing force (kgf) of the vane, T is a thickness (cm) of the vane, L is a height (cm) of the vane, and ΔP is a design pressure (kgf/cm$^2$) during operation.]

$$d=4\sqrt{\left(\frac{1-\nu_1^2}{\pi E1}+\frac{1-\nu_2^2}{\pi E2}\right)\cdot Fv\cdot\frac{\rho}{L}} \qquad \text{Expression (7)}$$

[where E1 is a modulus of longitudinal elasticity (kg/cm$^2$) of the vane, E2 is a modulus of longitudinal elasticity (kg/cm$^2$) of the roller, ν1 is a Poisson's ratio of the vane, ν2 is a Poisson's ratio of the roller, L is a height (cm) of the vane, Fv is pressing force (kgf) of the vane calculated by the expression (6), and ρ is an equivalent-radius (cm) calculated by the expression (5).]

Moreover, according to the present invention, in addition to claim 1 or 3, there is provided a rotary compressor defined in claim 4, wherein the vane is formed of an iron-based material having a modulus of longitudinal elasticity $1.96\times10^5$ to $2.45\times10^5$ N/mm$^2$.

Also, according to the present invention, in addition to claim 4, there is provided a rotary compressor defined in claim 5, wherein an outermost surface of the vane is subjected to nitriding treatment by which a compound layer having Fe and N as main components is formed and a diffusion layer having Fe and N as main components is formed under the compound layer.

Additionally, according to the present invention, in addition to claim 4, there is provided a rotary compressor defined in claim 6, wherein the surface of the vane is subjected to nitriding treatment by which only a diffusion layer having Fe and N as main components is formed.

Further, according to the present invention, in addition to claim 4, there is provided a rotary compressor defined in claim 7, wherein an outermost surface of the vane is subjected to nitriding treatment by which a compound layer having Fe and S as main components is formed and a diffusion layer having Fe—N as a main component is formed under the compound layer.

Furthermore, according to the present invention, in addition to claim 5, there is provided a rotary compressor defined in claim 8, wherein an outermost surface of the vane is subjected to nitriding treatment by which a compound layer having Fe and N as main components is formed and a diffusion layer having Fe and N as main components is formed under the compound layer, and the compound layer having Fe and N as main components provided on at least side surfaces of the vane is removed.

Moreover, according to the present invention, in addition to claim 7, there is provided a rotary compressor defined in claim 9, an outermost surface of the vane is subjected to nitriding treatment by which a compound layer having Fe and S as main components is formed and a diffusion layer having Fe—N as a main component is formed under the compound layer, and the compound layer having Fe and S as main components provided on at least side surfaces of the vane is removed.

In addition, according to the present invention, in addition to claims 1 to 9, there is provided to a rotary compressor defined in claim 10, wherein a material of the roller which slidingly comes into contact with the vane is formed of an iron-based material having a modulus of longitudinal elasticity $9.81\times10^4$ to $1.47\times10^5$ N/mm$^2$.

Additionally, according to the present invention, in addition to claims 1 to 10, there is provided a rotary compressor defined in claim 11, wherein kinetic viscosity of base oil is 30 to 120 mm$^2$/s at 40° C.

DETAILED DESCRIPTION OF THE PREFERRED EMBODIMENT

The present invention will now be described in detail hereinafter.

Figure 6:
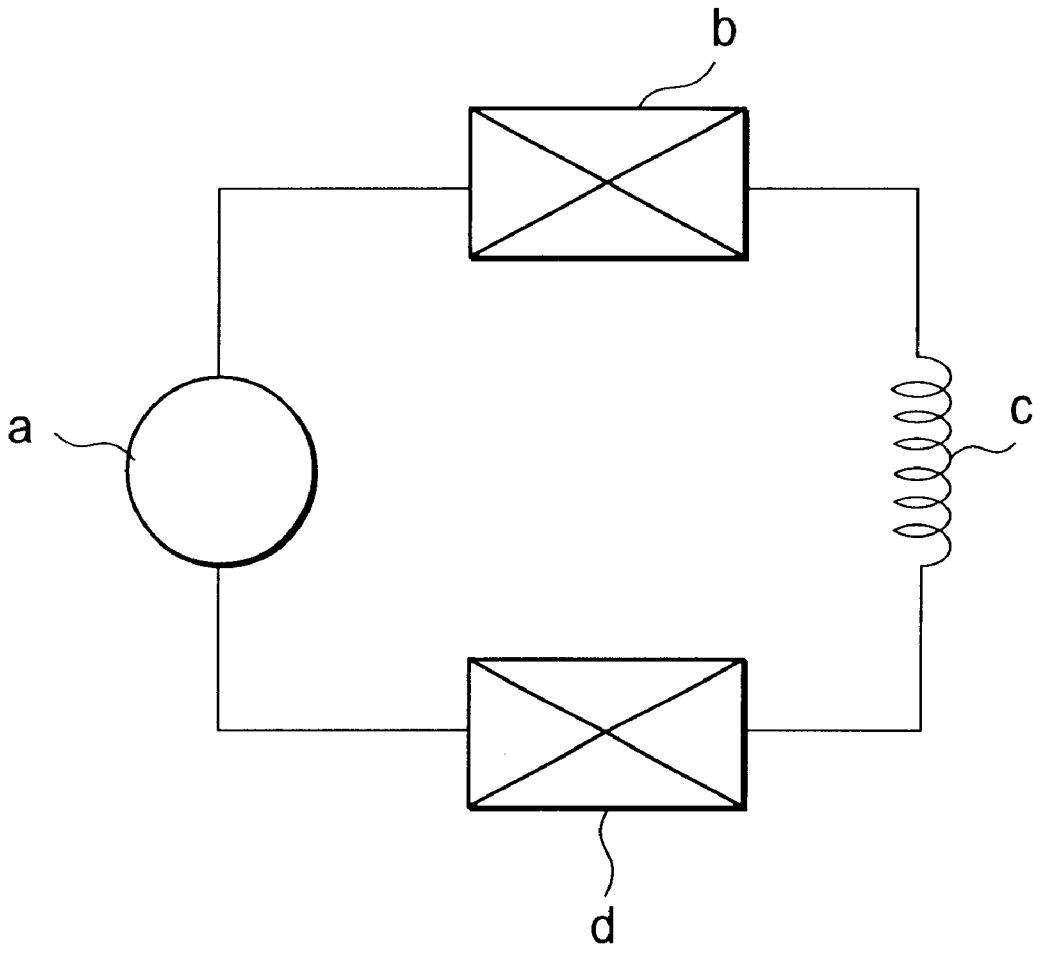
FIG. 6 is an explanatory view showing a refrigerating circuit of the rotary compressor illustrated in FIG. 1.

FIG. 6 shows an example of a refrigerating circuit which uses refrigerant pipes to sequentially connect a rotary compressor a according to the present invention which uses polyalkylene glycol or polyalfa olefin as lubricant base oil and compresses carbon dioxide as an example of carbonic acid gas which does not contain chloric molecules in molecules of, e.g., vaporized HFC-based refrigerant and which is a natural refrigerant, a condenser b which condenses and liquefies the refrigerant, an expander c which reduces pressure of the refrigerant, an evaporator d which evaporates the liquefied refrigerant and the like.

Figure 1:
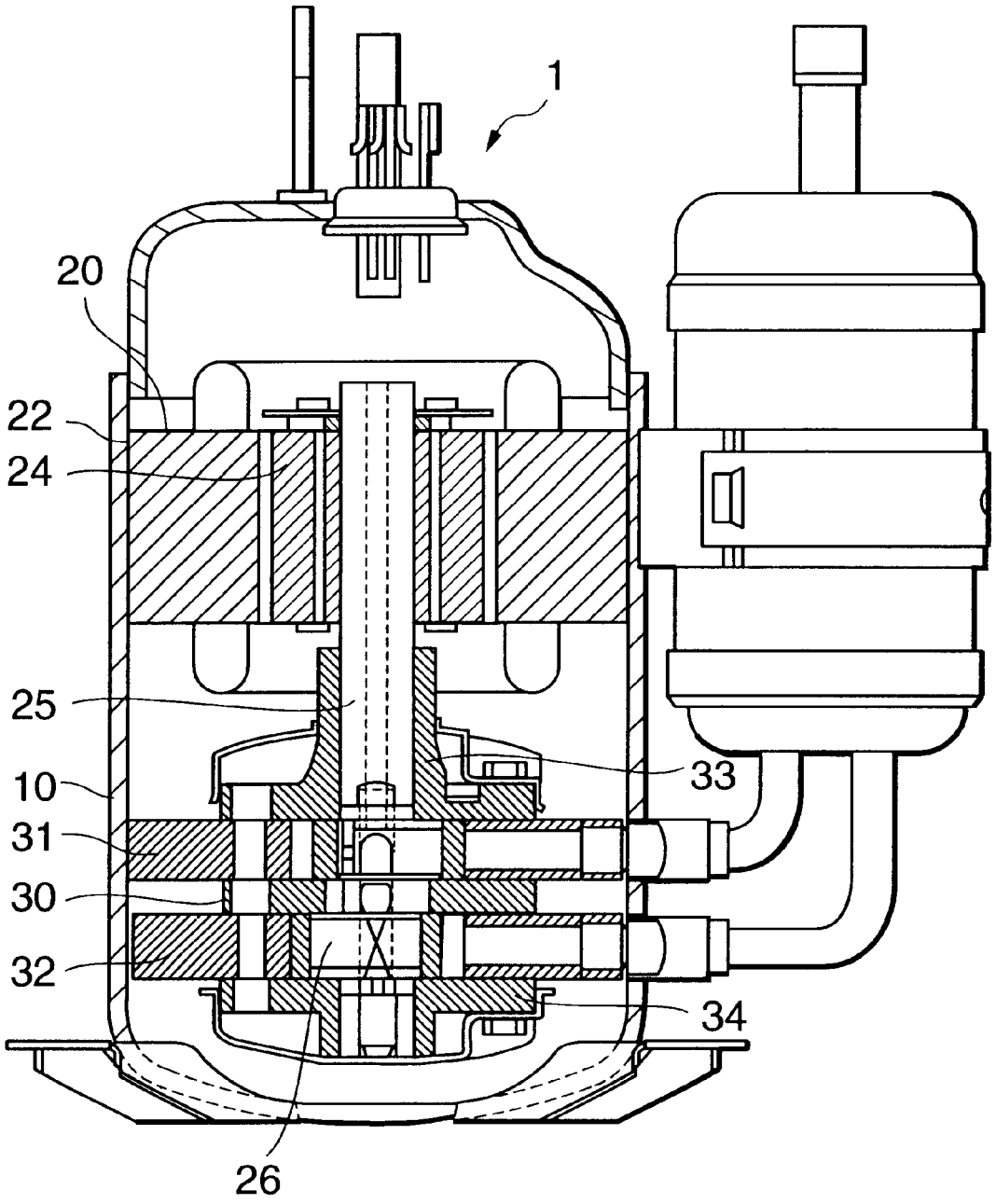
FIG. 1 is an explanatory view showing a cross-sectional structure of a two-cylinder type rotary compressor to which the present invention is applied.
Figure 2:
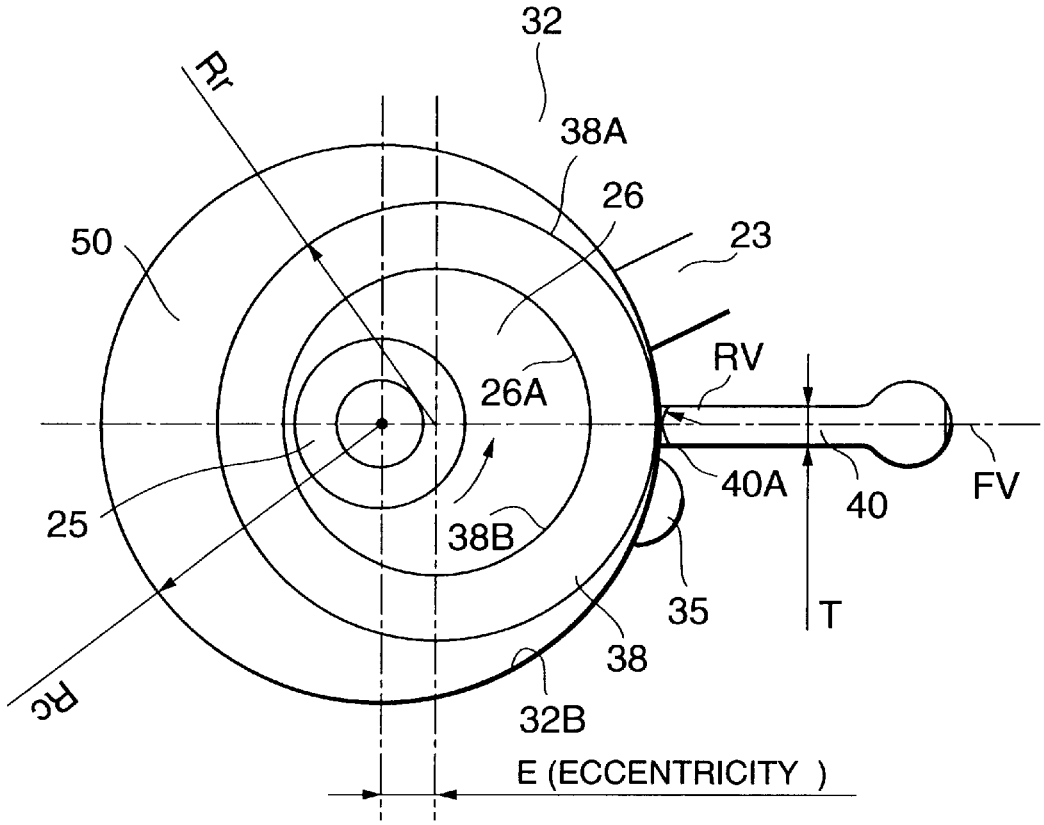
FIG. 2 is a cross-sectional explanatory view showing the relationship between a cylinder, a roller, a vane and others of the rotary compressor illustrated in FIG. 1.
Figure 3:
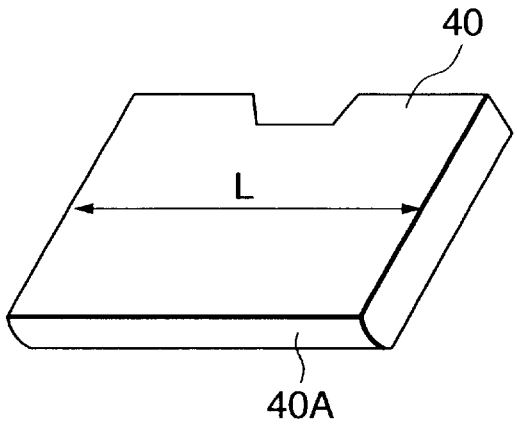
FIG. 3 is an explanatory view of the vane of the rotary compressor illustrated in FIG. 1.
Figure 4:
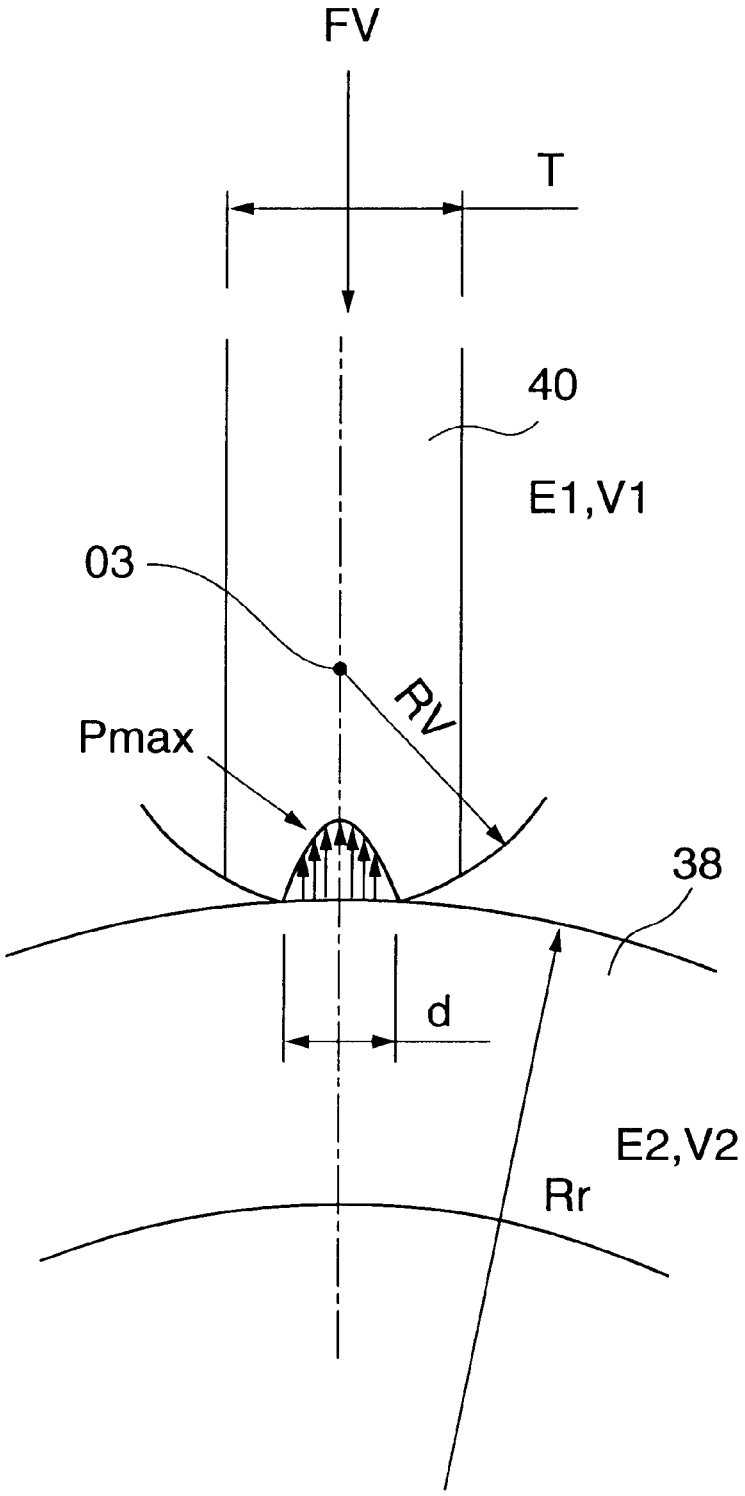
FIG. 4 is a cross-sectional explanatory view showing the relationship between the roller and the vane of the rotary compressor depicted in FIG. 1.
Figure 5:
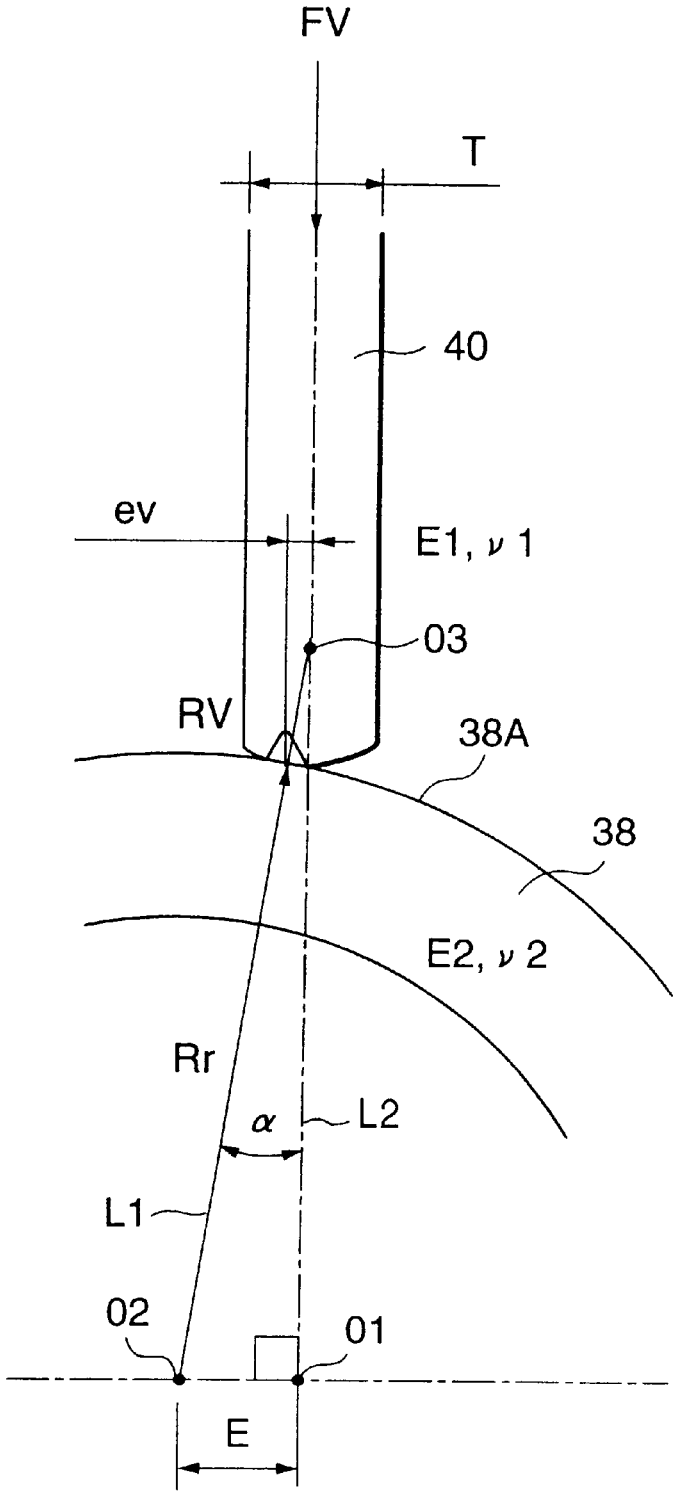
FIG. 5 is a cross-sectional explanatory view showing the relationship between a rotation center of a rotary shaft, a roller center, a center of a radius of curvature of the vane and others of the rotary compressor depicted in FIG. 1.

FIG. 5 is a cross-sectional explanatory view showing the relationship between a roller and a vane of the rotary compressor according to the present invention.

In FIG. 5, assuming that eccentricity (cm) of a rotation center (O1) of a rotary shaft 25 and a roller center (O2) of a roller 38 is E, an angle formed by a linear line (L1) connecting a center (O3) of a radius of curvature (Rv) of a vane 40 and the roller center (O2) and a linear line (L2) connecting the center (O3) and the rotation center (O1) of the rotary shaft 25 is $\alpha$, and a sliding distance between a point at which the linear line (L1) intersects an outer peripheral surface 38A of the roller 38 and a point at which the roller 38 intersects the outer peripheral surface 38A is ev, ev can be calculated by the expression (4).

When a radius of curvature (Rv) at a sliding contact portion of the vane 40 with respect to the roller 38, a thickness (T) of the vane 40, a radius of curvature of the outer periphery (Rr) of the roller 38 which slidingly comes into contact with the vane 40, eccentricity (E), a modulus of longitudinal elasticity E1 of the vane 40, a modulus of longitudinal elasticity E2 of the roller 38, a Poisson's ratio $\nu$1 of the vane 40, a Poisson's ratio $\nu$2 of the roller 38, and a design pressure $\Delta P$ are specifically set, $\rho$ can be calculated by the expression (5); pressing force Fv of the vane, the expression (6); a length of an elastic contact surface d, the expression (7), and the Hertz stress Pmax, the expression (9).

For example, in the two-cylinder type rotary compressor having a cylinder internal diameter 39 mm×a height 14 mm, eccentricity (E) 2.88 mm and a displacement volume 4.6cc×2, Table 1 shows a result of calculation of $\rho$, Fv, d, ev, (T−ev−d)/2, Pmax or the like when T, Rr, E1, E2, $\nu$1, $\nu$2, $\Delta P$ have values shown in Table 1 and Rv is changed as 3.2 mm, 4 mm, 6 mm, 8 mm, 10 mm, and 16.6 mm (same as Rr).

| Dimensions, material items | | | | | | | | | |
|---|---|---|---|---|---|---|---|---|---|
| 1. CYLINDER height H | mm | 14.00 | 14.00 | 14.00 | 14.00 | 14.00 | 14.00 | 14.00 | 14.00 |
| 2. VANE thickness T | mm | 3.20 | 3.20 | 3.20 | 3.20 | 3.20 | 3.20 | 3.20 | 3.20 |
| 3. VANE nose R | mm | 3.20 | 4.00 | 5.00 | 5.50 | 6.00 | 8.00 | 10.00 | 16.60 |
| 4. ROLLER R | mm | 16.60 | 16.60 | 16.60 | 16.60 | 16.60 | 16.60 | 16.60 | 16.60 |
| 5. Eccentricity E | mm | 2.880 | 2.880 | 2.880 | 2.880 | 2.880 | 2.880 | 2.880 | 2.880 |
| 6. VANE Young's modulus E1 | kg/cm$^2$ | 2.10E+06 | 2.10E+06 | 2.10E+06 | 2.10E+06 | 2.10E+06 | 2.10E+06 | 2.10E+06 | 2.10E+06 |
| 7. ROLLER Young's modulus E2 | kg/cm$^2$ | 1.10E+06 | 1.10E+06 | 1.10E+06 | 1.10E+06 | 1.10E+06 | 1.10E+06 | 1.10E+06 | 1.10E+06 |
| 8. VANE Poisson's ratio $\nu$1 | — | 0.30 | 0.30 | 0.30 | 0.30 | 0.30 | 0.30 | 0.30 | 0.30 |
| 9. ROLLER Poisson's ratio $\nu$2 | — | 0.30 | 0.30 | 0.30 | 0.30 | 0.30 | 0.30 | 0.30 | 0.30 |
| 10. Maximum pressure difference (design pressure) | kg/cm$^2$ | 100.00 | 100.00 | 100.00 | 100.00 | 100.00 | 100.00 | 100.00 | 100.00 |
| Result of calculation | | | | | | | | | |
| 1. Vane presssing force Fv | kg | 44.800 | 44.800 | 44.800 | 44.800 | 44.800 | 44.800 | 44.800 | 44.800 |
| 2. Equivalent - radius $\rho$ | cm | 0.26828 | 0.32233 | 0.38426 | 0.41312 | 0.44071 | 0.53984 | 0.62406 | 0.83000 |
| 3. Roller length I | cm | 1.4 | 1.4 | 1.4 | 1.4 | 1.4 | 1.4 | 1.4 | 1.4 |
| 4. Deformation length d | cm | 0.00742 | 0.00814 | 0.00889 | 0.00921 | 0.00952 | 0.01053 | 0.01132 | 0.01306 |

-continued

| | | | | | | | | | |
|---|---|---|---|---|---|---|---|---|---|
| 5. Sliding distance Ev | mm | 0.93091 | 1.11845 | 1.33333 | 1.43348 | 1.52920 | 1.87317 | 2.16541 | 2.88000 |
| [Ev/T] | | 29.1% | 35.0% | 41.7% | 44.8% | 47.8% | 58.5% | 67.7% | 90.0% |
| (T − Ev − d)/2 | mm | 1.13417 | 1.04037 | 0.93289 | 0.88280 | 0.83492 | 0.66289 | 0.51673 | 0.15935 |
| 6. Pmax | $kg/mm^2$ | 54.88 | 50.07 | 45.86 | 44.23 | 42.82 | 38.69 | 35.98 | 31.20 |
| | | 100% | 91% | 84% | 81% | 78% | 70% | 66% | 57% |

Assuming that the Hertz stress is 100% when T=Rv based on Table 1, the Hertz stress is reduced as Rv is increased. On the other hand, ev (sliding distance) is increased. When Rv=10 mm, the Hertz stress Pmax becomes 66%, and ev is approximately 2.3-fold. However, when Rv 16.6 mm=Rr, although the Hertz stress becomes 57%, (T−ev−d) /2≈0.16 is obtained, and it can be understood that the sliding contact surface is hard to be assured at the sliding portion of the vane and the roller.

Based on the above-described result, it can be realized that the sliding surface at the sliding contact portion of the vane and the roller can be assured while Hertz stress can be reduced when Rv falls in a range of T<Rv<Rr represented by the expression (1), the sliding distance (ev) is increased, the stress is dispersed, and a temperature at the sliding contact portion of the vane and the roller is lowered, thereby preventing abnormal abrasion of the roller and the vane.

The inexpensive nitriding treatment (NV nitriding, sulphonitriding, radical nitriding) has an effect to satisfactorily reduce abrasion of the outer peripheral surface of the roller or the vane without applying the expensive coating treatment to the vane, thereby providing the highly reliable rotary compressor.

When T falls within a range of T>2·Rv·E/(Rv+Rr) represented by the expression (2), the sliding surface at the sliding contact portion of the vane and the roller can be safely assured.

When T falls within a range of T>[2·Rv·E/(Rv+Rr)]+d represented by the expression (8), the sliding surface at the sliding contact portion of the vane and the roller can be safely assured even during the high-load operation.

The vane is formed of an iron-based material having a modulus of longitudinal elasticity $1.96\times10^5$ to $2.45\times10^5$ $N/mm^2$. However, when the modulus of elasticity is too small, the abrasion resistance power of the vane is insufficient. When it is too large, the elastic deformation can not be expected, the stress can not be reduced, and the abrasion resistance power can not be obtained.

Japanese patent application laid-open No. 141269/1998, Japanese patent application laid-open No. 217665/1999, Japanese patent application laid-open No. 73918/1993 and others disclose that the vane whose surface is subjected to nitriding treatment by which only a diffusion layer having Fe and N as main components is formed, the vane whose outermost surface is subjected to nitriding treatment by which a compound layer having Fe and N as main components is formed and a diffusion layer having Fe and N as main components is formed under the compound layer, or the vane whose outermost surface is subjected to nitriding treatment by which a compound layer having Fe and S as main components is formed and a diffusion layer having Fe—N as a main component is formed under the compound layer is effective for the abrasion resistance power of the vane. However, the abrasion resistance power is not sufficient under the HFC refrigerant.

As a countermeasure, in the present invention, the radius of curvature (Rv) of the vane at the sliding contact portion between the vane and the roller can be calculated by the expressions (1) to (8), and the above-described treatment is also applied to the vane having a shape with such a radius of curvature (Rv), thereby obtaining the higher abrasion resistance power.

Moreover, the vane whose outermost surface is subjected to nitriding treatment by which a compound layer having Fe and N as main components is formed and a diffusion layer having Fe and N as main components is formed under the compound layer and from which the compound layer having Fe and N as main components provided on at least side surfaces of the vane is removed, or the vane whose outermost surface is subjected to nitriding treatment by which a compound layer having Fe and S as main components is formed and a diffusion layer having Fe—N as a main component is formed under the compound layer and from which the compound layer having Fe and S as main components provided on at least side surfaces of the vane is removed can cope with a change in dimensions caused due to a change in crystal structure by the treatment. Even if the compound layer is removed by, for example, grinding for readjustment of dimensions, the high abrasion resistance power can be obtained.

A material of the roller which slidingly comes into contact with the vane is formed of an iron-based material having a modulus of longitudinal elasticity $9.81\times10^4$ to $1.47\times10^5$ $N/mm^2$. When the modulus of longitudinal elasticity is too small, the abrasion resistance power of the roller is insufficient. When it is too large, elastic deformation can not be expected, the stress between the vane and the roller can not be reduced, and the abrasion resistance power can not be obtained.

In the present invention, kinetic viscosity of base oil which is polyalkylene glycol or polyalfa olefin or mineral oil used in the rotary compressor utilizing carbon dioxide as a refrigerant is not particularly restricted to a specific value. However, it is preferable for the kinetic viscosity of the base oil to be 30 to 120 $mm^2/s$ at 40° C. When the kinetic viscosity of the base oil is less than 30 $mm_2/s$, abrasion at the sliding contact portion may not be possibly prevented. When it exceeds 120 $mm^2/s$, uneconomical results, e.g., increase in power consumption may be obtained.

Incidentally, since the present invention is not restricted to the above-described embodiment, various modifications can be carried out without departing from the scope defined by claims.

In the rotary compressor according to claim 1 of the present invention, even though a refrigerant which does not contain chlorine in molecules, and polyalkylene glycol as a lubricant or polyalfa olefin as base oil are used, the Hertz stress can be reduced while assuring the sliding contact surface at the sliding contact portion of the vane and the roller, the sliding distance (ev) becomes large, the stress can be dispersed, and a temperature at the sliding contact portion of the vane and the roller can be lowered, thereby preventing abnormal abrasion of the roller and the vane.

In the rotary compressor according to claim 1 of the present invention, there is an effect to sufficiently reduce abrasion of the outer peripheral surface of the roller or the vane by the inexpensive nitriding treatment (NV nitriding, sulphonitriding, radical nitriding) without applying expensive coating treatment to the vane, and the high reliability can be thereby provided.

In the rotary compressor according to claim 2 of the present invention, the sliding contact surface at the sliding contact portion of the vane with respect to the roller can be assured.

In the rotary compressor according to claim 3 of the present invention, the sliding surface at the sliding contact portion of the vane with respect to the roller can be assured even during the high-load operation.

In the rotary compressor according to claim 4 of the present invention, the stress can be reduced in consideration of elastic deformation, and the abrasion resistance power of the vane can be improved.

In the rotary compressor according to claim 5 of the present invention, the abrasion resistance power of the vane can be improved.

In the rotary compressor according to claim 6 of the present invention, the abrasion resistance power of the vane can be improved.

In the rotary compressor according to claim 7 of the present invention, the abrasion resistance power of the vane can be improved.

In the rotary compressor according to claim 8 of the present invention, the abrasion resistance power of the van can be improved.

In the rotary compressor according to claim 9 of the present invention, the abrasion resistance power of the vane can be improved.

In the rotary compressor according to claim 10 of the present invention, the stress can be reduced in consideration of elastic deformation and the abrasion resistance power of the vane can be improved.

In the rotary compressor according to claim 11 of the present invention, there is an effect to reduce abrasion while maintaining low power consumption, and the reliability is high.

What is claimed is:

1. A rotary compressor having a refrigerating circuit which sequentially connects a compressor, a condenser, an expander, and an evaporator by pipes, using carbonic acid gas as a refrigerant, and polyalkylene glycol or polyalfa olefin as a lubricant or mineral oil as base oil, said rotary compressor comprising:

a cylinder having an inlet and an outlet; a rotary shaft having a crank portion provided on an axial line of said cylinder;

a roller which is provided between said crank portion and said cylinder and eccentrically rotates;

a vane which reciprocates in a groove provided to said cylinder and slidingly comes into contact with an outer peripheral surface of said roller, wherein a radius of curvature (Rv) (cm) of said vane at a sliding contact portion with respect to said roller can be represented by the following expression:

$$T<Rv<Rr \qquad \text{Expression (1)}$$

where T is a thickness (cm) of said vane and Rr is a radius of curvature of an outer periphery of said roller which slidingly comes into contact with said vane.

2. The rotary compressor according to claim 1, wherein, in order to assure a sliding contact surface of said vane at said sliding contact portion with respect to said roller, T, Rv, Rr, E, α, and ev have the relationship represented by the following expressions (2) to (4):

$$T>2\cdot Rv\cdot E/(Rv+Rr) \qquad \text{Expression (2)}$$

$$\sin\alpha=E/(Rv+Rr) \qquad \text{Expression (3)}$$

$$ev=Rv\cdot E/(Rv+Rr) \qquad \text{Expression (4)}$$

where E is eccentricity (cm) of a rotation center (O1) of said rotary shaft and a roller center (O2), α is an angle formed by a linear line (L1) connecting a center (O3) of a radius of curvature (Rv) of said vane and said roller center (O2) and a linear line (L2) connecting said center (O3) and said rotation center (O1), and ev is a sliding distance between a point at which said linear line (L1) intersects an outer peripheral surface of said roller and a point at which said linear line (L2) intersects said outer peripheral surface of said roller is.

3. The rotary compressor according to claim 1, wherein, in order to assure said sliding contact surface at said sliding contact portion between said vane and said roller, T, Rv, Rr, E and d have the relationship represented by the following expression (8):

$$T>[2\cdot Rv\cdot E/(Rv+Rr)]+d \qquad \text{Expression (8)}$$

wherein T. Rv, and Rr represent the same terms as those in the expression (1), where E is eccentricity (cm) of a rotation center (01) of said rotary shaft and roller center (02), where L (cm) is a height of said vane, each of E1 and E2 (kgf/cm$^2$) is a modulus of longitudinal elasticity of said vane and said roller, each of ν1 and ν2 is a Poisson's ratio of said vane and said roller, ΔP (kgf/cm$^2$) is a design pressure, ρ is an equivalent-radius calculated by the expression (B), Fv (kgf) is pressing force of said vane calculated by the expression (6), and d (cm) is a length of an elastic contact surface calculated by the expression (7) utilizing these terms, $$\frac{1}{\rho}=\frac{1}{Rv}+\frac{1}{Rr} \qquad \text{Expression (5)}$$

wherein ρ is an equivalent-radius (cm), Rv is a radius of curvature (cm) of said vane, and Rr is a radius of curvature (cm) of an outer periphery of said roller which slidingly comes into contact with said vane.

$$Fv=T\cdot L\cdot\Delta P \qquad \text{Expression (6)}$$

wherein Fv is pressing force (kgf) of said vane, T is a thickness (cm) of said vane, L is a height (cm) of said vane, and ΔP is a design pressure (kgf/cm$^2$) during operation, $$d=4\sqrt{\left(\frac{1-\nu_1^2}{\pi E1}+\frac{1-\nu_2^2}{\pi E2}\right)\cdot Fv\cdot\frac{\rho}{L}} \qquad \text{Expression (7)}$$

wherein E1 is a modulus of longitudinal elasticity (kg/cm$^2$) of said vane, E2 is a modulus of longitudinal elasticity (kg/cm$^2$) of said roller, ν1 is a Poisson's ratio of said vane, ν2 is a Poisson's ratio of said roller, L is a height (cm) of said vane, Fv is pressing force (kgf) of said vane calculated by the expression (6), and ρ is an equivalent-radius (cm) calculated by the expression (5).

4. The rotary compressor according to any of claims 1 to 3, wherein said vane is formed of an iron-based material having a modulus of longitudinal elasticity $1.96\times10^5$ to $2.45\times10^5$ N/mm$^2$.

5. The rotary compressor according to claim 4, wherein an outermost surface of said vane is subjected to nitriding treatment by which a compound layer having Fe and N as main components is formed and a diffusion layer having Fe and N as main components is formed under said compound layer.

6. The rotary compressor according to claim 5, wherein an outermost surface of said vane is subjected to nitriding treatment by which a compound layer having Fe and N as main components is formed and a diffusion layer having Fe and N as main components is formed under said compound layer, and said compound layer having Fe and N as main components provided at least on side surfaces of said vane is removed.

7. The rotary compressor according to claim 4, wherein a surface of said vane is subjected to nitriding treatment by which only a diffusion layer having Fe and N as main components is formed.

8. The rotary compressor according to claim 4, wherein an outermost surface of said vane is subjected to nitriding treatment by which a compound layer having Fe and S as main components is formed and a diffusion layer having Fe—N as a main component is formed under said compound layer.

9. The rotary compressor according to claim 8, wherein an outermost surface of said vane is subjected to nitriding treatment by which a compound layer having Fe and S as main components is formed and a diffusion layer having Fe—N as a main component is formed under said compound layer, and said compound layer having Fe and S as main components provided at least on side surfaces of said vane is removed.

10. The rotary compressor according to any one of claims 1 to 3, wherein a material of said roller which slidingly comes into contact with said vane is formed of an iron-based material having a modulus of longitudinal elasticity $9.81\times10^4$ to $1.47\times10^5$ N/nm$^2$.

11. The rotary compressor according to any of claims 1 to 3, wherein kinetic viscosity of said base oil is 30 to 120 mm$^2$/s at 40° C.

* * * * *